US008287259B2

(12) United States Patent
Yoshimura

(10) Patent No.: US 8,287,259 B2
(45) Date of Patent: Oct. 16, 2012

(54) OIL-COOLED TYPE SCREW COMPRESSOR

(75) Inventor: Shoji Yoshimura, Takasago (JP)

(73) Assignee: Kobe Steel, Ltd., Tokyo (JP)

( * ) Notice: Subject to any disclaimer, the term of this patent is extended or adjusted under 35 U.S.C. 154(b) by 216 days.

(21) Appl. No.: 12/864,827

(22) PCT Filed: Feb. 4, 2009

(86) PCT No.: PCT/JP2009/051874

§ 371 (c)(1),
(2), (4) Date: Jul. 27, 2010

(87) PCT Pub. No.: WO2009/099095

PCT Pub. Date: Aug. 13, 2009

(65) Prior Publication Data

US 2010/0329916 A1 Dec. 30, 2010

(30) Foreign Application Priority Data

Feb. 6, 2008 (JP) ..... 2008-026677

(51) Int. Cl.
*F01C 1/16* (2006.01)
*F03C 2/00* (2006.01)

(52) U.S. Cl. ..... 418/201.1; 418/84; 418/98; 418/100; 418/270; 418/DIG. 1; 384/590; 384/606

(58) Field of Classification Search ..... 418/84, 418/88, 94, 98, 100, 201.1–201.2, 206.6–206.8, 418/206.3, 270, DIG. 1, 83, 91; 384/590, 384/606–607; 184/6.16–6.18
See application file for complete search history.

(56) References Cited

U.S. PATENT DOCUMENTS

| | | | | |
|---|---|---|---|---|
| 4,181,474 | A * | 1/1980 | Shaw | 418/201.2 |
| 5,707,223 | A | 1/1998 | Englund et al. | |
| 6,048,101 | A * | 4/2000 | Rasmussen | 384/616 |
| 6,059,551 | A * | 5/2000 | Amano et al. | 418/84 |
| 2005/0013521 | A1 | 1/2005 | Yoshimura et al. | |
| 2005/0018936 | A1 * | 1/2005 | Yoshimura et al. | 418/201.1 |
| 2006/0165335 | A1 | 7/2006 | Yoshimura et al. | |
| 2008/0152529 | A1 * | 6/2008 | Yoshimura | 418/91 |
| 2009/0191082 | A1 * | 7/2009 | Yoshimura et al. | 418/83 |

FOREIGN PATENT DOCUMENTS

| | | |
|---|---|---|
| JP | 2005 69186 | 3/2005 |
| JP | 3766725 | 2/2006 |
| JP | 3887415 | 2/2007 |

* cited by examiner

*Primary Examiner* — Theresa Thieu
(74) *Attorney, Agent, or Firm* — Oblon, Spivak, McClelland, Maier & Neustadt, L.L.P.

(57) ABSTRACT

An oil-cooled type screw compressor includes shafts mounted on rotors in a casing and extended to two sides of the rotors. Thrust plates rotate with the shafts. The thrust plates are sealed while spacing them from the rotors and define first and second spaces. Thrust bearings are arranged in the first and second spaces. An oil feed passage communicates with the one of the first and second spaces that is located on the side to apply a force against the thrust force to the thrust plates when boosted. An oil discharge passage communicates with the one of the first and second spaces that is located on the side to apply a force against the anti-thrust force to the thrust plates when boosted, to establish the communication between the space inside and an oil discharge target. An oil distribution passage distributes oil between the first space and the second space.

5 Claims, 8 Drawing Sheets

RELATED ART

RELATED ART

OIL-COOLED TYPE SCREW COMPRESSOR

TECHNICAL FIELD

The present invention relates to an improvement of an oil-cooled type screw compressor, and, more particularly, relates to an oil-cooled type screw compressor applied to a refrigerating system and the like.

BACKGROUND ART

A compressor body of an oil-cooled type screw compressor is provided with a rotor casing for storing a pair of male and female screw rotors meshing with each other. While rotor shafts on both ends of the pair of male and female screw rotors are supported by radial bearings, a pair of tilting pad thrust bearings for receiving a thrust force generated on the screw rotors are provided on one of rotor-shaft end portions of the pair of respective male and female screw rotors. The tilting pad thrust bearings (referred to as thrust bearings hereinafter) are provided at positions where a disk-shaped thrust member, which fits over one of the rotor-shaft end portions of the pair of respective male and female screw rotors, is between the thrust bearings. Therefore, the thrust bearings are in contact with sliding surfaces of the thrust member to receive a thrust force transmitted from the screw rotors to the thrust member. As such an oil-cooled type screw compressor which can reduce a thrust force, a conventional example described in a patent document 1 is known, for example.

A description will now be given of an outline of the oil-cooled type screw compressor according to this conventional example referring to accompanying drawings. FIG. 6 is a diagram showing an overall configuration of the oil-cooled type screw compressor according to the conventional example, FIG. 7 is a diagram showing an internal configuration of a compressor body of the oil-cooled type screw compressor according to the conventional example, and FIG. 8 is an enlarged view of a portion of thrust bearings and a balance piston of the compressor body of the oil-cooled type screw compressor according to the conventional example.

The illustrated oil-cooled type screw compressor includes: a compressor body 53, one side of which is connected to a suction flow passage 51, and the other side of which is connected to a discharge flow passage 52; and an oil feed flow passage 57 which connects an oil sump unit 55 at a bottom portion of an oil separator/collector 54 provided on the discharge flow passage 52 and main lubricated portions inside the compressor body 53, via an oil pump 56. Between a downstream side of the oil separator/collector 54 and an upstream side of the oil pump 56, a uniform pressure flow passage 58 branches, and communicates with the compressor body 53 as described later.

As shown in FIG. 7, the compressor body 53 includes a casing, which is not shown, and a pair of male and female screw rotors 61 disposed in the casing and meshing with each other. The screw rotors 61 are rotatably supported by the radial bearings 63 at rotor shafts 62 extending from each of the screw rotors 61. In FIG. 7, the left side is a suction side, the right side is a discharge side, two arrows on the left side indicate an inflow of a suction gas, and an arrow on the right side indicates an outflow of a discharge gas. Moreover, reference numerals Ps and Pd in the drawing denote a suction pressure of the suction gas and a discharge pressure of the discharge gas respectively.

Moreover, in case of the compressor shown in FIG. 7, the rotor shaft 62 of one rotor (male rotor) 61 which extends leftward includes an input shaft 65 which receives a rotational driving force by a motor, which is not shown. Further, the thrust bearings 66 are provided on the rotor shaft 62 to the right side of the radial bearing 63 on the discharge side of each of the rotors 61. On the other hand, a disc-shaped thrust plate 64 is fitted near the other end of each of the rotor shafts 62, and a pair of thrust bearings 66 for receiving the thrust force generated on the screw rotors 61 is provided on both sides of the thrust plate 64. The thrust bearings 66 are in contact with sliding surfaces of each of the thrust plates 64, and receives the thrust force transmitted from the screw rotor 61 to the thrust plate 64.

Moreover, a balance piston 67 is fixed at the other end of each of the rotor shafts 62. A partition flange 81 is provided between the balance piston 67 and the thrust bearings 66. Within an internal peripheral portion of the partition wall 81, shaft seal means 82 having an airtight/fluidtight property is fitted to each of the rotor shafts 62. This shaft seal means 82 blocks the pressure between a space AS storing the thrust bearings 66 and a space BS storing the balance piston 67 while permitting the rotation of the corresponding rotor shaft 62. Therefore, the space BS is separated from the other components such as the input shaft 65, thrust bearings 66, and radial bearings 63. In case of this oil-cooled type screw compressor, as described above, the compressor body 53 has a single stage configuration. Even in case of an oil-cooled type screw compressor provided with the multiple staged compressor body 53, same configuration is possible.

In the compressor body 53 of the oil-cooled type screw compressor having this configuration, as shown in FIG. 7, the suction pressure Ps from the suction flow passage 51 is introduced from the side of the input shaft 65 to the space AS, and the oil at a discharge pressure Pd+$\alpha$ (note that $\alpha>0$) is fed from the oil feed flow passage 57 to the radial bearings 63. On the other hand, the oil supplied from the uniform pressure flow passage 58 to the balance piston 67 side and having pressure Pd which is adjusted to be equivalent to the discharge pressure Pd is led to the surface, on the thrust bearing 66 side, of the balance piston 67 in the space BS.

As shown in FIGS. 6 and 7, basically, the suction flow passage 51 is at the suction pressure Ps, the discharge flow passage 52 is at the discharge pressure Pd, a primary side of the oil pump 56 on the oil feed flow passage 57 is at the discharge pressure Pd, and a secondary side of the oil pump 56 is at the oil feed pressure Pd+$\alpha$ (note that a$\alpha>0$), though there is some pressure change. And a relationship in magnitude of the respective pressures is represented as:

$$Ps<Pd<Pd+\alpha$$

Thus, as described above, the introduction of the suction pressure Ps and the discharge pressure Pd+$\alpha$ into the space As, and the introduction of the pressure-adjusted oil into the space Bs largely contribute to the reduction of the thrust force, which has been a problem.

Moreover, in the conventional example shown in FIGS. 6 to 8, not only the thrust force is reduced, it can also provide measures against an problematic anti-thrust load immediately after a startup, during an unload operation, and the like. In other words, in case of the small load of the compressor, namely in case of the small thrust force, such as immediately after the startup, and during the unload operation, a force which is larger than and against the force applied to the screw rotors 61 in a direction from the discharge side to the suction side, that is so-called anti-thrust load, may be applied. However, in the conventional example shown in FIG. 6 to 8, the partition wall 81 for blocking the pressure is provided between the thrust bearings 66 and the balance pistons 67, and the uniform pressure flow passage 58 for introducing, without pressurizing, the oil in the oil sump unit to the space, on the partition wall 81 side, of the balance pistons 67 is provided. Therefore, such anti-thrust load can be efficiently prevented.

Assuming that the outer diameter of the balance pistons 67 is D, and the shaft diameter of the balance pistons 67 is d, a force:

$$F=(D^2-d^2)\cdot(n/4)Pd$$

acts on each of the balance pistons 67.

Since the force F is proportional to the discharge pressure Pd, the force F becomes small when force applied to the screw rotors 61 in the direction from the discharge side to the suction side is small, such as immediately after the startup of the compressor body 53, and during the unload operation. Thus, an excessive anti-thrust force is not generated, and even if the bearings are worn, a collision of the screw rotors 61 with a wall portion of a rotor chamber is avoided. In this way, in the conventional example, the pressure receiving areas of the balance pistons 67 are increased, and also the thrust bearings 66 having a large load capacity are employed to prevent the generation of a state of the anti-thrust load.

However, since the thrust bearings 64 are provided at positions remote from the screw rotors 61, and the balance pistons 67 are provided at further remote positions, this configuration is not sufficiently compact though it is more compact than earlier "compressor bodies".

[Patent Document 1] Japanese Patent No. 3766725

DISCLOSURE OF THE INVENTION

It is therefore an object of the present invention to provide an oil-cooled type screw compressor which can reduce a thrust fore applied to thrust bearings supporting rotor shafts of screw rotors, can avoid an anti-thrust load state during low load, and includes a compact compressor body.

According to a preferred embodiment of the present invention, an oil-cooled type screw compressor having a compressor body that compresses a suction gas, and discharges the compressed gas, includes: a rotor casing of the compressor body; a pair of male and female screw rotors that is stored in the rotor casing, and meshes with each other; rotor shafts that are provided for each of the screw rotors, and extend to both sides of each of the screw rotors respectively; a suction port that is provided for one side in a longitudinal direction of the screw rotors, and introduces the suction gas to the pair of screw rotors; a discharge port that is provided for the other side in the longitudinal direction of the screw rotors, and discharges the compressed gas compressed by the screw rotors; a disc-shaped thrust plate that is provided near either one of end portions, in the longitudinal direction, of each of the rotor shafts, and rotates integrally with the rotor shaft; a sealing member that seals the thrust plate rotatably while spacing it from the screw rotors, and that defines a first space and a second space on both sides of the thrust plate; a pair of thrust bearings that is disposed in the first space and the second space respectively, and receives a thrust force transmitted to the thrust plate placed between the thrust bearings; an oil feed passage that communicates with such one of the first space and the second space as is located on the side to apply a force in a direction against the thrust force to the thrust plate when boosted, and that establishes the communication between an inside of the space and an oil feed source; an oil discharge passage that communicates with such one of the first space and the second space as is located on the side to apply a force in a direction against an anti-thrust force to the thrust plate when boosted, and that establishes the communication between an inside of the space and an oil discharge destination; and an oil distribution passage through which the oil is distributed between the first space and the second space.

According to this aspect, the suction gas is introduced from the one side in the longitudinal direction of the screw rotors, becomes gas compressed by the screw rotors, and is discharged to the other side in the longitudinal direction of the screw rotors. On the other hand, the oil is fed from the oil feed passage into either one of the first space and the second space, the oil accumulated in the one space is decompressed via the oil distribution passage, and flows into the other one of the first space and the second space, and the oil accumulated in the other space is discharged from the oil discharge passage. Though a thrust force in the longitudinal direction of the screw rotors from the other side to the one side acts on the thrust bearings during this operation, the oil is fed into the one space to raise the pressure in the one space to a predetermined pressure compared with the other space, and apply a force against the thrust force to the thrust plate. Therefore, an operation equivalent to the balance pistons in a conventional example is provided, and the thrust force acting on the thrust bearings can be reduced. Thus, not similarly as the compressor body of the oil-cooled type screw compressor according to the conventional example, a space for installing balance pistons is not necessary, and a compressor body can be made compact. Moreover, the oil is distributed to the other space by providing the oil distribution passage, and the discharge pressure of the oil fed from the oil feed source is reduced. Thus, a function for restraining the so-called anti-thrust force, which is a problem during low load, is obtained. Moreover, when the area for the thrust plate is extremely limited, the restraint of the anti-thrust force during low load and the restraint of the thrust force during high load can be balanced as much as possible only by the adjustment of the oil quantity distributed in the oil distribution passages, which further contributes to a size reduction Further objects, configurations, and operational effects of the present invention will be clearer from the following preferred embodiments of the present invention described referring to drawings.

BEST MODES FOR CARRYING OUT THE INVENTION

A description will now be given of preferred embodiments of the present invention referring to accompanying drawings. In the following description, as to the portion similar to conventional configuration, like components are denoted by like numerals, and will not be further explained.

Moreover, though means for reducing a thrust force generated on each of a pair of male and female screw rotors of a compressor body 1 are different in size from each other, they have completely the same configuration in principle, thus a description will be given of the configuration of the means for reducing the thrust force generated on one (male) screw rotor which is driven, and a description of the configuration of the means for reducing the thrust force generated on the other (female) screw rotor which is passively moved will be omitted.

Figure 1:
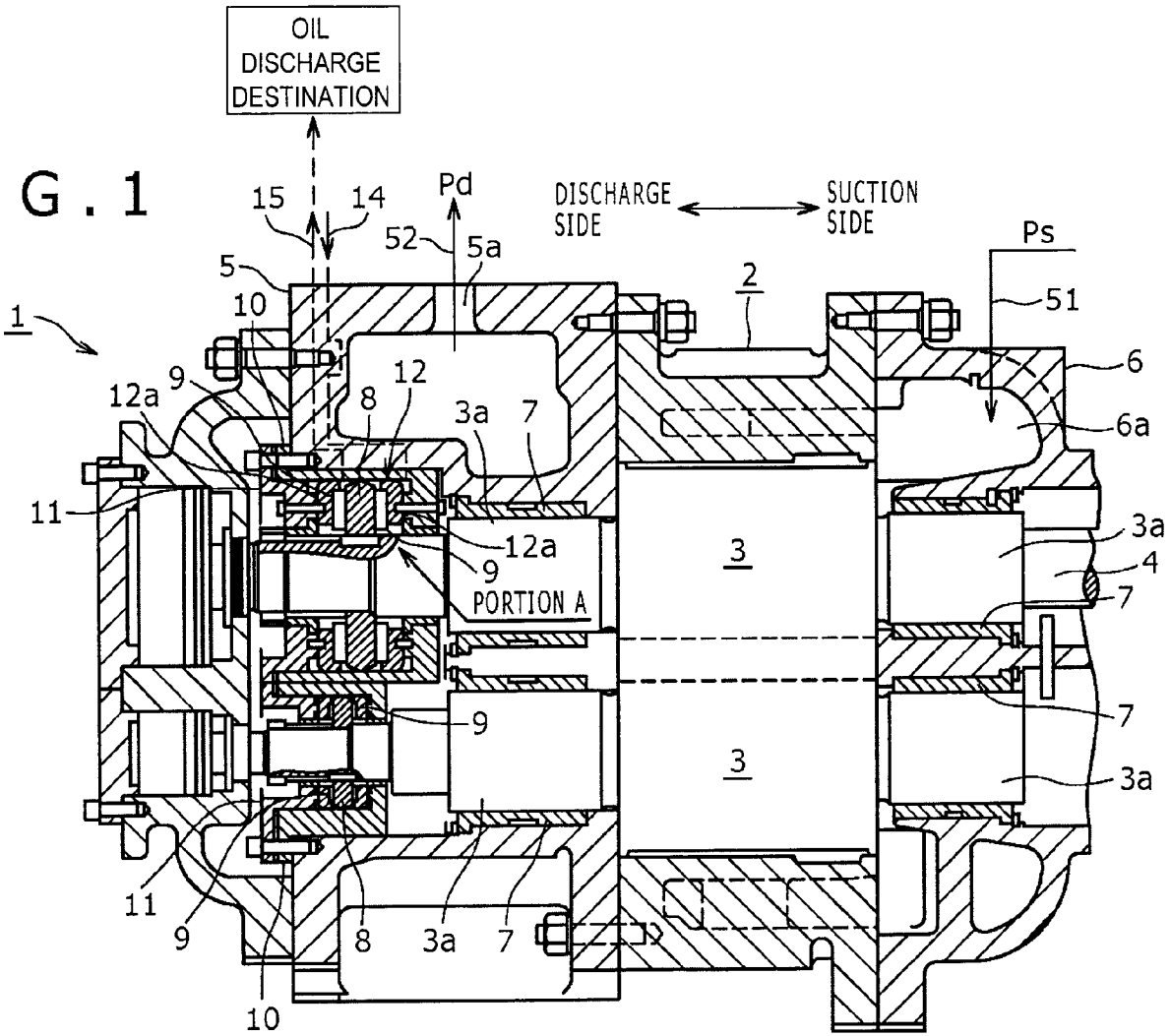
FIG. 1 A cross sectional view of a main portion according to an embodiment of the present invention, and showing a configuration of a compressor body of an oil-cooled type screw compressor.
Figure 6:
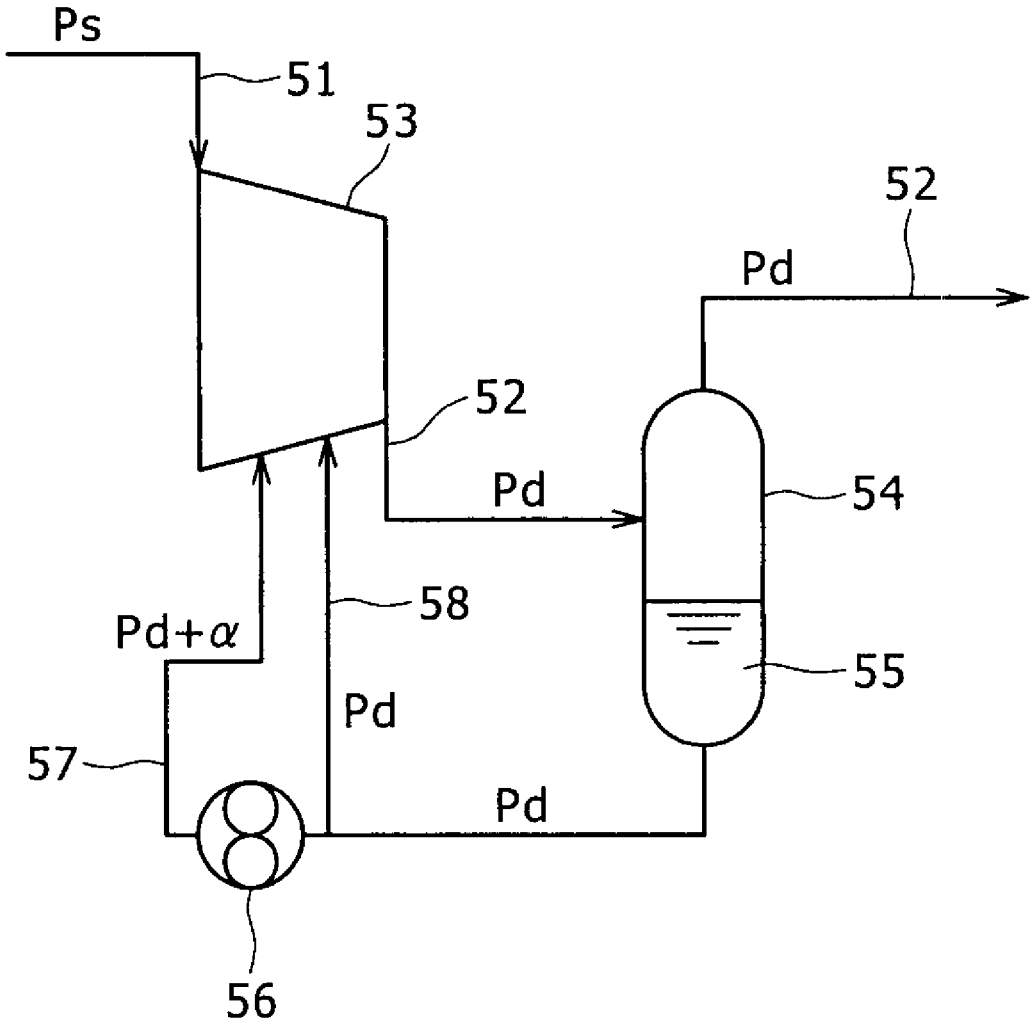
FIG. 6 A diagram according to a conventional example, and showing an overall configuration of an oil-cooled type screw compressor.
Figure 7:
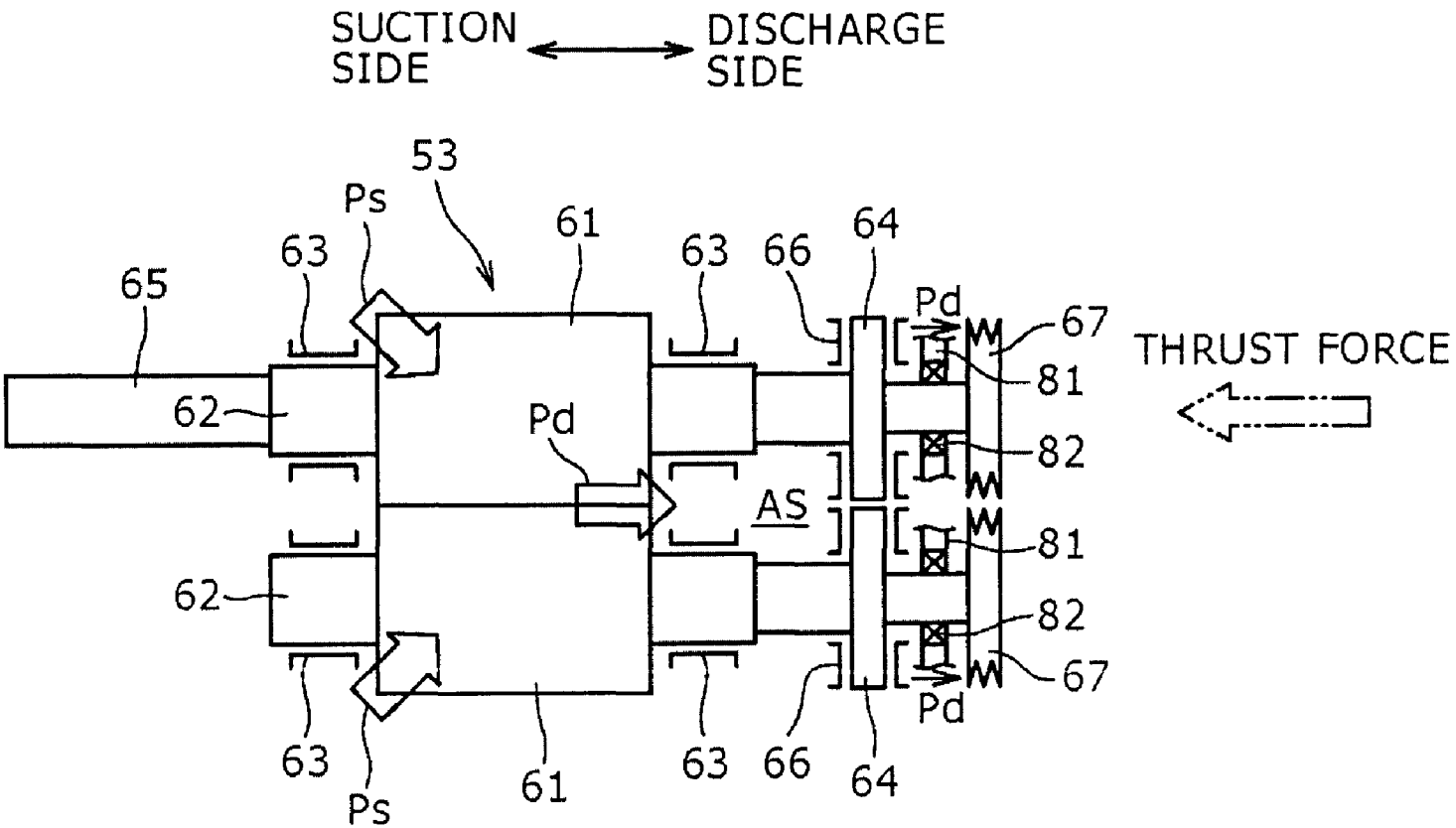
FIG. 7 RELATED ART
FIG. 7 A diagram according to the conventional example, and showing an internal configuration of a compressor body of the oil-cooled type screw compressor.
Figure 8:
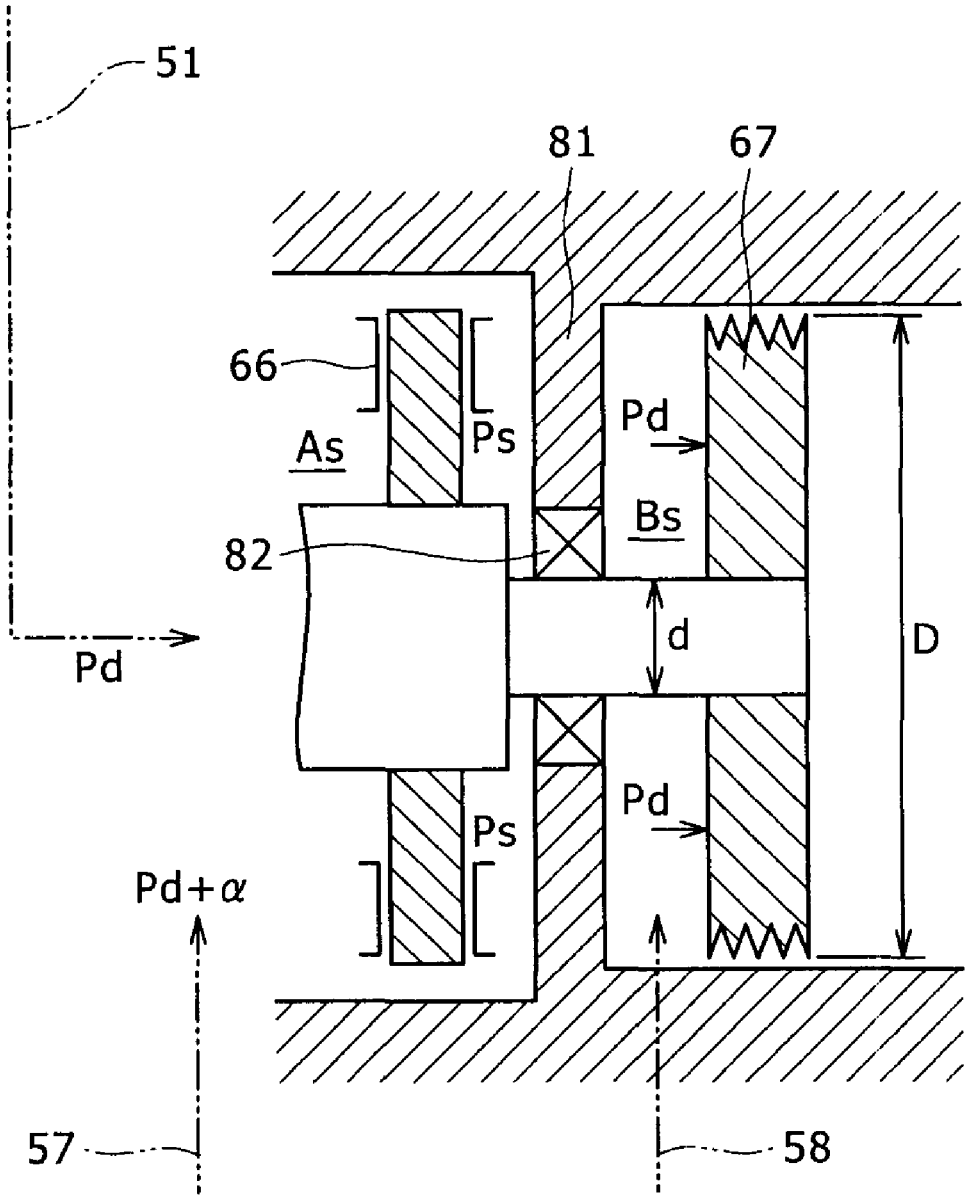
FIG. 8 A diagram according to the conventional example, and enlarging a portion of thrust bearings and a balance piston of the compressor body of the oil-cooled type screw compressor.

First, referring to FIG. 1, the oil-cooled type screw compressor according to the present embodiment includes the compressor body 1 and an oil flow passage, which is not shown, for feeding oil to the compressor body 1. Similarly as a conventional example shown in FIG. 6, this oil flow passage basically includes an oil feed line 16 for feeding oil from the oil sum unit of the oil separator/collector to the compressor body 1, and a discharge path for discharging oil discharged from the compressor body 1. It should be noted that the present embodiment is significantly different from the conventional example in a simple configuration without the uniform pressure flow passage 58 according to the conventional example. Moreover, in the oil flow passage, a suction flow passage 51 for supplying a suction gas to the compressor body 1 and a discharge flow passage 52 for discharging a compressed gas are provided (refer to FIG. 3).

The compressor body 1 of the oil-cooled type screw compressor according to the present embodiment includes a rotor casing 2. In the rotor casing 2, a pair of male and female screw rotors 3 meshing with each other are stored. One screw rotor (male screw rotor) 3 of the pair of male and female screw rotors 3 is rotated by a motor, which is not shown, via an input shaft 4, and the other screw rotor (female screw rotor) 3 is passively rotated by the rotation of the one screw rotor 3. The suction flow passage 51 is connected to a suction port 6*a* formed on a right end portion of the screw rotors 3 in FIG. 1, and a discharge flow passage 52 is connected to a discharge port 5*a* formed on a left end portion of the screw rotors 3 in FIG. 1.

Rotor shafts 3*a* on both sides of respective screws of the pair of male and female screw rotors 3 are supported by radial bearings 7 fitted in bearing boxes of bearing cases 5, 6 fixed by bolts to opening ends of the rotor casing 2. Moreover, a disc-shaped thrust member 8 is fitted via a key concentrically on a small-diameter shaft portion of the left rotor shaft 3*a* in FIG. 1. The small-diameter shaft portion is outside the left radial bearings 7 in the longitudinal direction of the pair of male and female screw rotors 3.

Moreover, tilting pad thrust bearings 12 each provided with rolling elements 9 in rolling contact with the thrust member 8 are provided on the both sides of the thrust member 8. The rolling elements 9 in rolling contact with a surface of the thrust member 8 on the radial bearing 7 side are attached to a disk-shaped bearing holding member 12*a* fixed to a first bearing holder 10 in a bottomed cylindrical shape fixed with bolts to an end surface of the bearing case 5. Moreover, the rolling elements 9 in sliding contact with a surface of the thrust member 8 on the opposite side of the radial baring 7 are attached to the disk-shaped bearing holding member 12*a* fixed to a second bearing holder 11 including a flange portion which is fixed with the bolts to the end surface of the bearing case 5 through a flange portion of the first bearing holder 10.

The tilting pad thrust bearing 12 includes the bearing holding member 12*a* provided concentrically with the corresponding rotor shaft 3*a*, and the multiple (eight, for example) rolling elements 9 attached at evenly distributed positions on a circle about an axis of the bearing holding member 12*a*. According to the present embodiment, along with the tilting pad thrust bearings 12 serving as thrust bearings, the first and second bearing holders 10, 11 construct an example of a sealing member for sealing the thrust members 8. Between the first bearing holder 10 and the thrust member 8, a first space S1 sealing one of the tilting pad thrust bearings 12 is defined. This first space S1 is a space which is defined between a side surface of the thrust member 8 on the screw rotor 3 side and an inner bottom surface of the first bearing holder 10, stores the rolling elements 9 and the bearing holding member 12*a*, and applies, as a result of an increase in internal pressure thereof, a force acting against a thrust force (a thrust force acting from the left side to the right side in FIG. 1 and FIG. 2) to the thrust member 8.

On the other hand, between the second bearing holder 11 and the thrust member 8, a second space S2 sealing the other tilting pad thrust bearings 12 is defined. This second space S2 is a space which is defined between a side surface of the thrust member 8 on the opposite side of the screw rotor 3 and an outer bottom surface of the second bearing holder 11, stores the rolling elements 9 and the bearing holding member 12*a*, and applies, as a result of an increase in internal pressure thereof, a force against an anti-thrust force (a force acting from the right side to the left side in FIG. 1 and FIG. 2) to the thrust member 8.

In the bearing case 5 and the first bearing holder 10, an oil feed flow passage 14 passing through the bearing case 5 and the first bearing holder 10, and communicating with the first space S1 is provided. An oil feed line 16 from an oil sump unit of an oil separator/collector provided in an oil feed source having configuration similar to that shown in FIG. 6 (note that an oil passage corresponding to the uniform pressure oil passage 58 is not provided in the present embodiment) communicates via the oil feed flow passage 14 with the first space S1 to feed oil via the oil feed line 16 and the oil feed flow passage 14 into the first space S1.

Further, seal rings 13, 13 constructing a part of the sealing member in the present embodiment are provided between inner peripheral surfaces of through holes provided at the radial center of bottom plate members of the first bearing holder 10 and the second bearing holder 11 and an outer peripheral surface of the small-diameter shaft portion of the rotor shaft 3*a* outside the radial bearing 7. These seal rings 13, 13 are configured to seal the first space S1 and the second space S2 inside the first bearing holder 10 while permitting the rotation of the rotor shaft 3*a*, and are thus configured to prevent the oil inside the first and second spaces S1, S2 from leaking into the rotor shaft side. Moreover, in the present embodiment, an O ring is fitted into a seal ring groove provided around an outer periphery of each of the first bearing holder 10 and the second bearing holder 11 to prevent the oil from leaking to the bearing box side of the bearing case 5.

In case of the oil-cooled type screw compressor according to the present embodiment, as described above, the oil is fed from the oil sump unit at the bottom of the oil separator/collector for separating the oil component from the compressed gas, via the oil feed line 16 and oil feed flow passage 14, to the first space S1. Thus, the devices which are almost always provided is utilized in this configuration, and it is not necessary to provide an independent oil feed source, and therefore the increase in the cost of the oil-cooled type screw compressor can be suppressed. Further, this will not suppress the reduction of the size of the oil-cooled type screw compressor itself.

Figure 2:
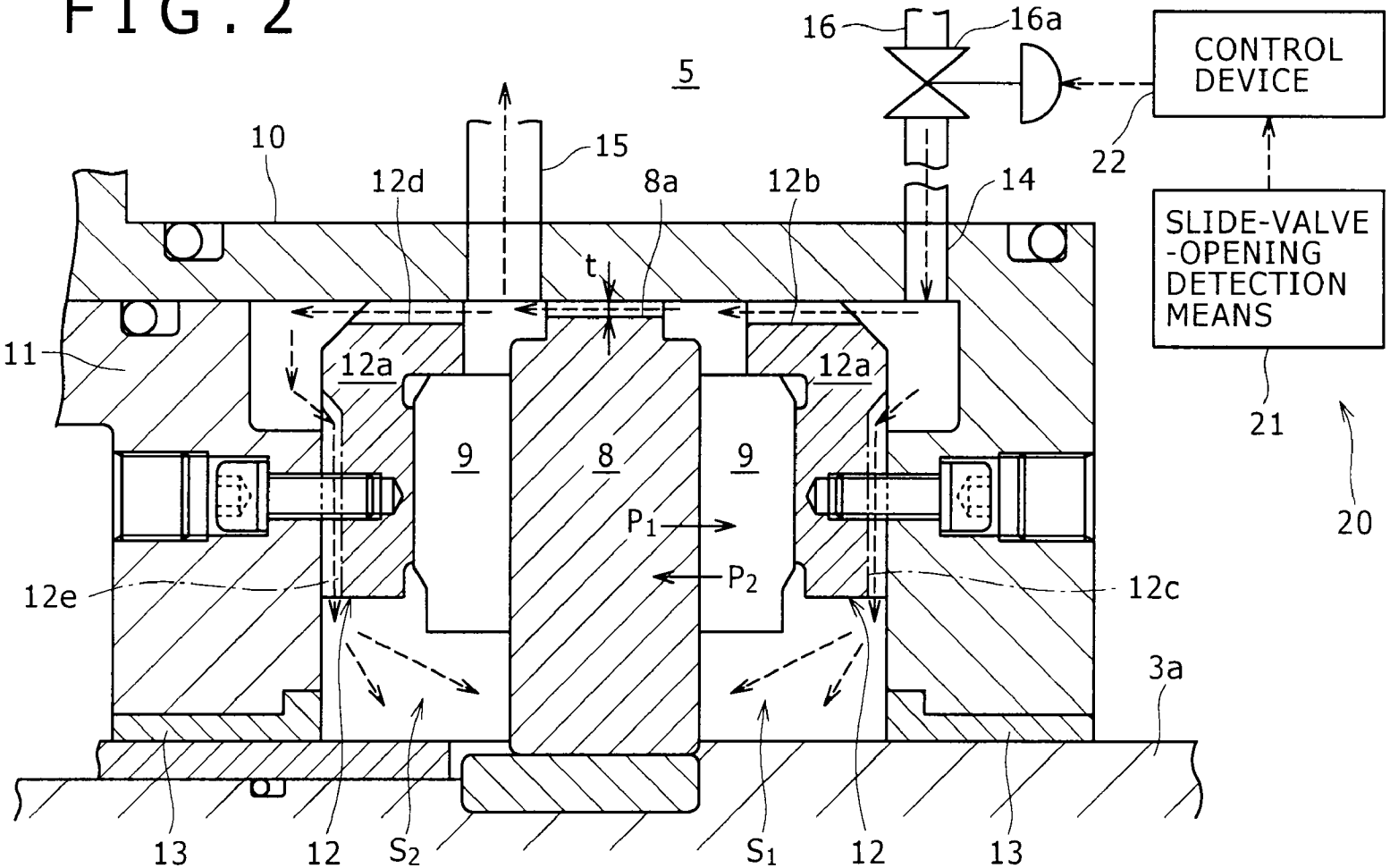
FIG. 2 A diagram showing an enlarged view of a portion A in FIG. 1, and a configuration of pressure adjustment means for adjusting a pressure of an oil fed to an oil feed flow passage.

According to the illustrated embodiment, on an outer peripheral surface of the bearing holding member 12*a*, multiple horizontal grooves 12*b* for oil communication (only one of them is illustrated in FIG. 2) establishing the communication between the thrust member 8 side and the opposite side of the thrust member 8 are formed along the axial direction. Moreover, on the side surface of the member 12*a* opposite to the thrust member 8, radial grooves 12*c* for oil communication (only one of them is illustrated in FIG. 2) which provides the communication from the side surface near an outer periphery of the bearing holding member 12*a* to an inner peripheral surface side are formed. By these grooves 12*b*, 12*c*, the oil fed from the oil feed flow passage 14 quickly fills the first space S1, thereby increasing the pressure of the first space S1.

Then, oil distribution passages 8*a* are formed between the outer peripheral surface of the thrust member 8 and the inner peripheral surface of the first bearing holder 10. In the illustrated example, on the outer periphery of the thrust member 8, the oil distribution passages 8*a* are realized by multiple grooves (only one of them is illustrated in FIG. 2) along the axial direction and having depth of t. Via this oil distribution passages 8*a*, the depressurized oil flows from the first space S1 to the second space S2. Moreover, on an outer peripheral surface of the bearing holding member 12*a* stored in the second space S2, multiple horizontal grooves for oil communication 12*d* (only one of them is illustrated in FIG. 2) establishing the communication between the thrust member 8 side and the side opposite to the thrust member 8 are formed along the axial direction. Further, on the side surface, opposite to the thrust member 8, of the bearing holding member 12*a* stored in the second space S2, radial grooves 12*e* for oil communication (only one of them is illustrated in FIG. 2) providing the communicating from a side surface near the outer periphery of the bearing holding member 12*a* to an inner peripheral surface side are formed. By these grooves 12*d*, 12*e*, the oil flowing from the first space through the oil distribution passage 8*a* is fed at a predetermined rate into the second space S2. On this occasion, as the quantity of the oil fed to the first space S1 increases, the pressure inside the first space S1 increases. Therefore, a difference in pressure of oil between the inside of the first space S1 and the inside of the second space S2 increases to resist the thrust force which increases as a discharge quantity of the compressed gas increases.

In the bearing case 5 and the first bearing holder 10, an oil discharge flow passage 15 is provided. The oil discharge flow passage 15 passes through the bearing case 5 and the first bearing holder 10 to discharge the oil in the second space S2 to an oil discharge destination side connected to a suction pressure portion of the compressor. The oil discharge flow passage 15 and an oil discharge line, which is not shown, form an oil discharge passage establishing the communication between the inside of the second space S2 and the oil discharge destination is formed.

Figure 3:
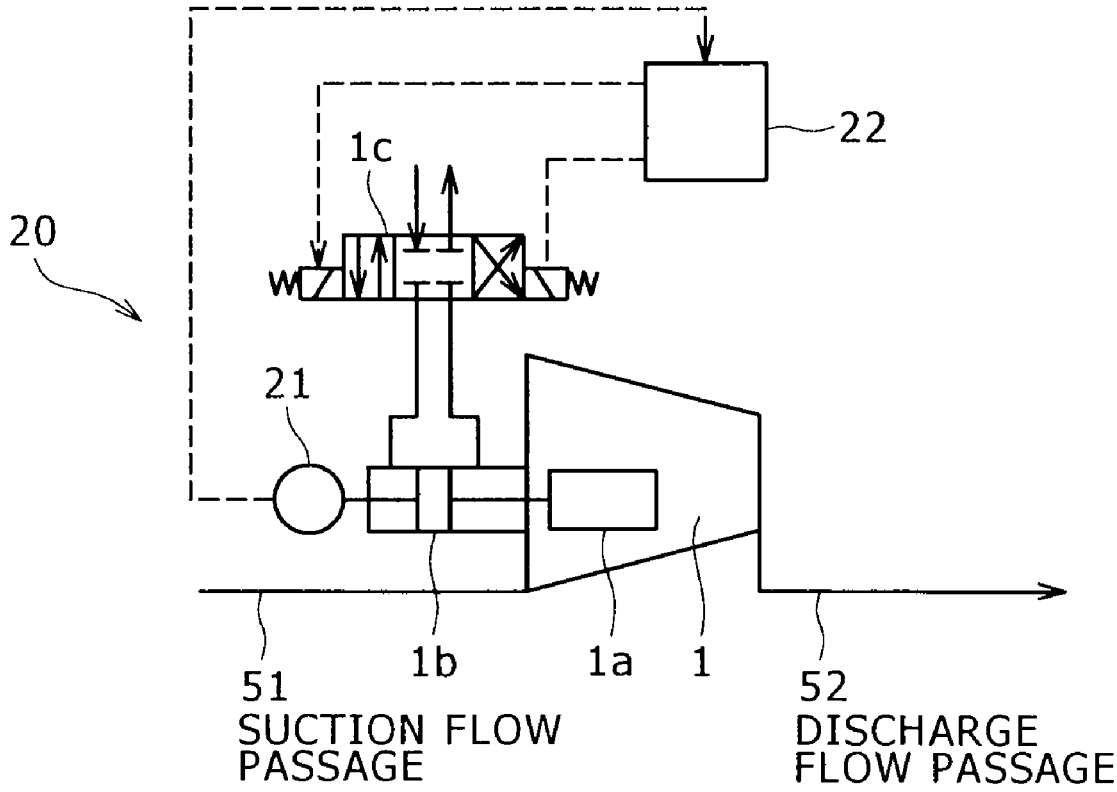
FIG. 3 A schematic view according to an embodiment of the present invention, and showing a configuration of a slide-valve-opening degree detection means for detecting an opening degree of a slide valve.

A description will now be given of an oil suction/discharge system. On the oil feed line 16, a flow control valve (flow control means) 16*a*, opening degree of which is controlled, is interposed. The opening degree of the flow control valve 16*a* is controlled by a valve control system 20. In other words, as shown in FIGS. 2, 3, a stroke of a valve operation cylinder 1*b* reciprocally operating a slide valve la (illustrated only in FIG. 3) which adjusts a discharge volume of the compressed gas of the compressor body 1 is detected by slide-valve-opening degree detection means 21 (such as a magnetostrictive sensor). When the stroke of the valve operation cylinder 1*b* detected by the slide-valve-opening degree detection means 21, namely an opening detection value of the slide valve 1*a* is input to the control device 22, the control device 22 controls the opening degree of the flow control valve 16*a* according to the opening degree of the slide valve 1*a*, and the oil of the quantity according to the opening degree of the flow control valve 16*a* is fed from the oil feed flow passage 14 to the first space S1. Upstream of the interposed position of the flow control valve 16*a* on the oil feed line 16, an oil pump similar to the oil pump 56 shown in FIG. 6 may be interposed to pressurize the oil fed to the first space S1.

A flow control valve which can be freely adjusted to an arbitrary opening degree is preferable, since it can arbitrarily adjust "a force P2 resisting a thrust force P1" described later, thus provides an excellent effect of reducing the thrust force acting on the thrust bearings. However, the open/close valve configured to maintain fully-opened and fully-closed opening degrees is not excluded, since an open/close valve configured to maintain fully-opened and fully-closed opening degrees may be replaced with this flow control vale, for example.

The valve operation cylinder 1*b* is configured to be controlled by the electromagnetic direction switching valve 1*c* as shown in FIG. 3. This electromagnetic direction switching valve 1*c* has three positions including a position of operating rightward in FIG. 3, a neutral position, and a position of operating leftward in FIG. 3, has a well-known four-port configuration, and is alternately excited by the control device 22 to switch a spool which is not illustrated.

Figure 4:
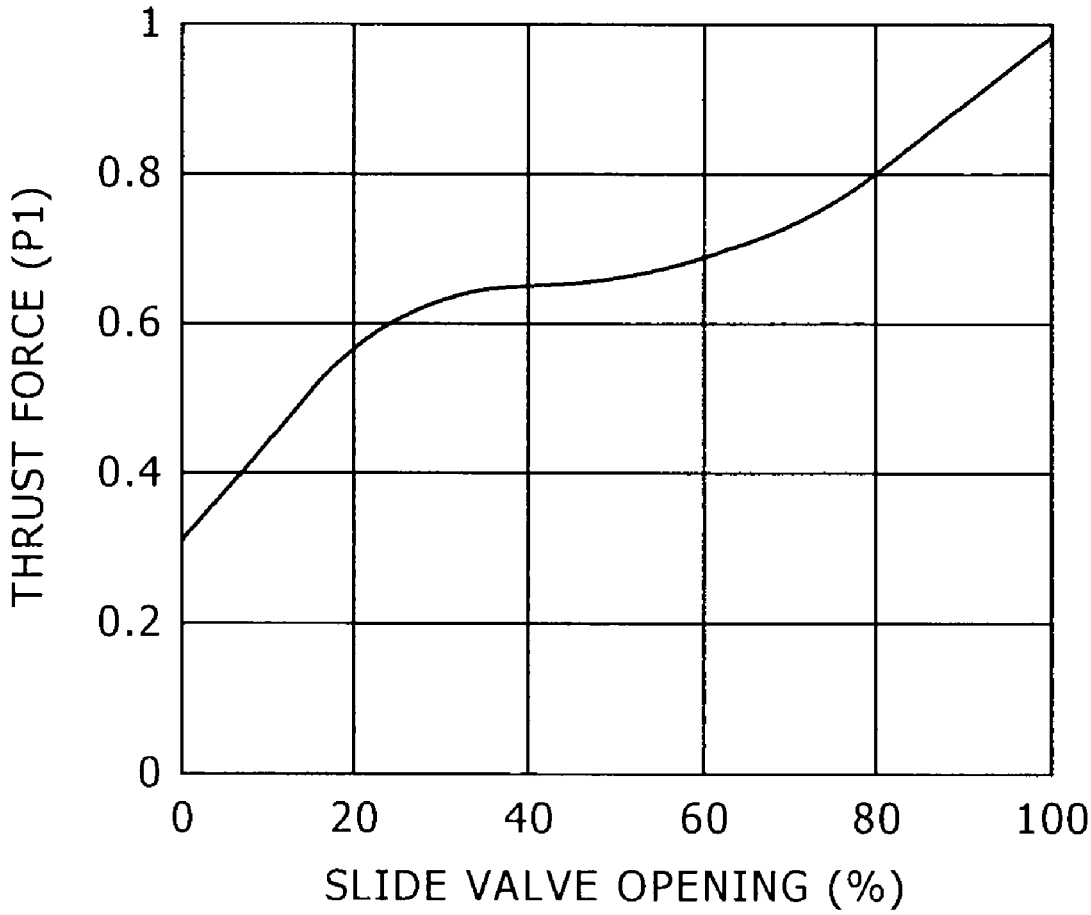
FIG. 4 A chart according to an embodiment of the present invention, and describing relationship between a thrust force F acting on a male screw rotor (vertical axis: dimensionless number from 0 to 1) and the slide valve opening degree (horizontal axis: 0 to 100%).

A description will now be given of operations and effects of the compressor body 1 of the oil-cooled type screw compressor configured as described above referring to drawings. Namely, when the operation of the compressor body 1 is stated, and the opening degree of the slide valve 1*a* is set to between 0% of no load and 100% of full load, the thrust force P1 generated on the male screw rotor 3 increases as the opening degree increases as shown in FIG. 4. More specifically, the thrust force P1 increases along a curve protruding slightly upward in a range of opening degree of the slide valve between 0% and 45%, transitions approximately horizontally in a range between 45% and 55%, and increases along a curve protruding slightly downward in a range between 55% and 100%. In this way, by changing the opening degree of the slide valve 1*a*, as illustrated in FIG. 2, the thrust force P1 generated on the male screw rotor 3 in the screw rotor direction (right direction in the drawing) changes largely.

However, according to the compressor body 1 of the oil-cooled type screw compressor according to the present embodiment, the oil is fed from the oil feed flow passage 14 to the first space S1 of the compressor body 1. The oil flowing from the oil feed flow passage 14 is accumulated, via the horizontal grooves 12*b* for oil communication and the radial grooves 12*c* for oil communication, in the first space S1, and the accumulated oil flows into the second space S2 on the opposite side of the screw rotor 3 while depressurized via the oil distribution passages 8*a*.

Then, the oil flowing into the second space S2 is accumulated, via the horizontal grooves for oil distribution 12*d* and the radial grooves for oil distribution 12*e*, in the second space S2, and the oil further flowing into the second space S2 is successively discharged from the oil discharge flow passage 15. Further, since the opening degree of the flow control valve 16*a* is controlled by the control device 22 to which a opening degree signal of the slide valve 1*a* detected by the slide-valve-opening degree detection means 21 is input, the oil of the quantity according to the opening degree of the slide valve 1*a* is fed to the first space S1.

Thus, according to the compressor body 1 of the oil-cooled type screw compressor according to the present embodiment, the pressure of the oil in the first space S1 is higher than the pressure of the oil in the second space S2, thereby reducing the thrust force generated on the screw rotor 3, and functions equivalent to the compressor body of the oil-cooled type screw compressor provided with the balance pistons according to the conventional example are provided.

In other words, as shown in FIG. 2, the resisting force P2 in the direction opposite to the screw rotor 3 (toward left in the drawing) in the first space S1 is generated to reduce the thrust force P1, resulting in a reduction of the load applied on the thrust bearings 12. Of course, as the discharge volume of the compressed gas discharged from the compressor body 1 increases, the thrust force P1 generated on the screw rotor 3 increases. However, the oil of a quantity corresponding to the discharge volume of the compressed gas (quantity increased as the load approaches the full load of 100%) is fed from the oil supply flow passage 14 into the first space S1, and when the quantity of the oil fed into the first space S1 exceeds the quantity of the oil flowing via the oil distribution passages 8*a* into the second space S2, the force P2 resisting the thrust force P1 increases. Thus, the thrust force acting on the tilting pad thrust bearings 12 will not increase as the discharge volume of the compressed gas increases.

Moreover, since the oil is distributed to the other space by providing the oil distribution passages 8*a*, the discharge pressure of the oil fed from the oil feed source is reduced, resulting in a function for restraining the so-called counter load state (state of P1<P2), which is a problem during a low load. Moreover, when the area for the thrust member 8 is extremely limited, the restraint of the anti-thrust force during low load and the restraint of the thrust force during high load can be balanced as much as possible only by the adjustment of the oil quantity distributed in the oil distribution passages 8*a*, which further contributes to a size reduction. Especially in the present embodiment, even if the uniform pressure flow passage 58, which is employed in the conventional example, is omitted, the anti-thrust load state during a low load can be avoided, which largely contributes to the size reduction and the simplification.

Furthermore, not similarly as the compressor body of the oil-cooled type screw compressor according to the conventional example, the compressor body 1 of the oil-cooled type screw compressor according to the present embodiment does not require a space for providing the balance pistons, on the side opposite to the screw rotors with respect to the tilting pad thrust bearings 12, and therefore, the size of the compressor body 1 can be reduced.

Figure 5:
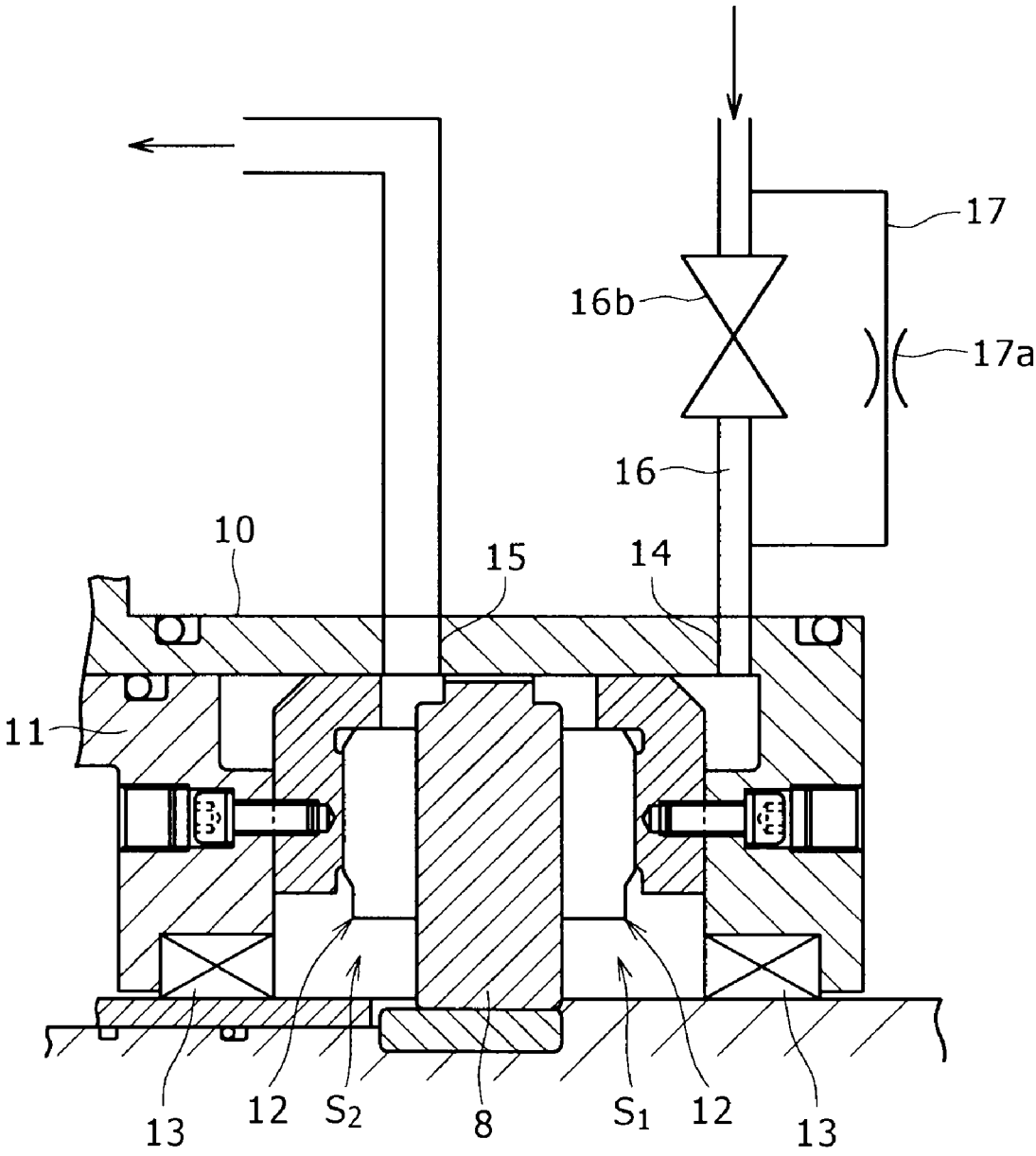
FIG. 5 A diagram describing an oil feed according to another embodiment of the present invention, and showing a part of a compressor body and a part of an oil feed line.

In the above configuration, description is given while using the case where the flow control valve 16*a* is interposed on the oil feed line 16 for feeding the oil to the oil feed flow passage 14 of the compressor body 1. However, the configuration is not limited to the above configuration, as shown in FIG. 5, which is a drawing describing the oil feed, showing a part of a compressor body and a part of the oil feed line a open/close valve 16*b* which can maintain the fully-opened opening degree and the fully-closed opening degree, for example, is provided instead of the flow control valve 16*a* of the oil feed line 16, a bypass line 17 establishing the communication between an upstream side and a downstream side of the open/close valve 16*b* may be provided, and a metering valve 17*a* may be interposed on the bypass line 17.

With this configuration, the quantity of the oil fed to the first space S1 is either a quantity of oil fed through both the open/close valve 16*b* and the bypass line 17 when the open/close valve 16*b* is fully opened, or a quantity of oil fed only through the bypass line 17 when the open/close valve 16*b* is fully closed. Therefore, in case of such a configuration, the effect of reducing the thrust force acting on the tilting pad thrust bearings 12 may be inferior to the case in which the flow control valve which can feed an arbitrary quantity of oil to the first space S1 according to the opening degree of the slide valve 1*a* is employed. However, this configuration is advantageously low cost.

The configuration of the compressor body is not limited to the configuration of the compressor body according to the above embodiment. Moreover, the configuration of the compressor body of the oil-cooled type screw compressor according to the above embodiment is merely a specific example of the present invention, and thus can be freely changed in design, etc. without departing from technical ideas of the present invention. For example, in the above-mentioned embodiment, the case in which the compressor body of the oil-cooled type screw compressor is configured as one stage is described as an example. However, the technical ideas of the present invention can be applied to an oil-cooled type screw compressor provided with a multi-stage compressor body, in addition to the one-stage configuration.

Moreover, in the above-mentioned embodiment, the explanation is given while using, as an example, the case where the suction flow passage is connected to the right end portion of the screw rotors 3 in FIG. 1, and the discharge flow passage is connected to the left end portion of the screw rotors 3 in FIG. 1, namely, the thrust members 8 are provided on the discharge side of the compressor body 1. However, the technical ideas of the present invention can be applied to an oil-cooled type screw compressor in which thrust plates are provided on the suction side of the compressor body, in addition to the above example. In this case, if the thrust plates are provided on the suction side of the compressor body, the first space is provided next to the thrust plate on the opposite side of the screw rotor with respect to the thrust plate, and the second space is provided next to the thrust plate on the opposite side of the first space (the screw rotor side) with respect to the thrust plate.

As mentioned above, the summary of the present invention is an oil-cooled type screw compressor having a compressor body that compresses a suction gas, and discharges the compressed gas, includes: a rotor casing of the compressor body; a pair of male and female screw rotors that is stored in the rotor casing, and meshes with each other; rotor shafts that are provided for each of the screw rotors, and extend to both sides of each of the screw rotors respectively; a suction port that is provided for one side in a longitudinal direction of the screw rotors, and introduces the suction gas to the pair of screw rotors; a discharge port that is provided for the other side in the longitudinal direction of the screw rotors, and discharges the compressed gas compressed by the screw rotors; a disc-shaped thrust plate that is provided near either one of end portions, in the longitudinal direction, of each of the rotor shafts, and rotates integrally with the rotor shaft; a sealing member that seals the thrust plate rotatably while spacing it from the screw rotors, and that defines a first space and a second space on both sides of the thrust plate; a pair of thrust bearings that is disposed in the first space and the second space respectively, and receives a thrust force transmitted to the thrust plate placed between the thrust bearings; an oil feed passage that communicates with such one of the first space and the second space as is located on the side to apply a force in a direction against the thrust force to the thrust plate when boosted, and that establishes the communication between an inside of the space and an oil feed source; an oil discharge passage that communicates with such one of the first space and the second space as is located on the side to apply a force in a direction against an anti-thrust force to the thrust plate when boosted, and that establishes the communication between an inside of the space and an oil discharge destination; and an oil distribution passage through which the oil is distributed between the first space and the second space.

In a preferred embodiment, the oil-cooled type screw compressor further includes a pair of radial bearings that is provided on both sides of each of the screw rotors, and is mounted on the rotor casing so as to support the rotor shafts of the screw rotors.

In a preferred embodiment, the oil-cooled type screw compressor includes: a slide valve that is provided for the compressor body, and adjusts a discharge capacity of the compressed gas; slide-valve-opening degree detection means that detects an opening degree of the slide valve; and flow rate control means that adjusts a flow rate of the oil fed to the first space according to the opening degree of the slide valve detected by the slide-valve-opening degree detection means to control the pressure of the oil in the first space.

In this embodiment, the oil in the quantity corresponding to the discharge volume of the compressed gas is fed from the oil feed passage to the first space. When the quantity of the oil exceeds the quantity of the oil flowing via the oil distribution passage into the second space, the force against the thrust force is generated by the oil in the first space, thereby reducing the thrust force. Therefore, the thrust force acting on the thrust bearings will not increase even when the thrust force generated on the screw rotors increases, as the discharge volume of the compressed gas discharged from the compressor body increases.

In a preferred embodiment, the flow rate control means is interposed on the oil feed passage, and is a flow-rate control valve, an opening degree of which can be controlled to an arbitrary opening degree.

In this embodiment, the force against the thrust force can be arbitrarily adjusted, and the excellent effect of canceling the thrust force acting on the thrust bearings can be provided.

In a preferred embodiment, the oil feed source is an oil sump unit at a bottom portion of an oil separator/collector that is interposed on a discharge flow passage for feeding the compressed gas discharged from the compressor body to a gas feed destination side, and separates an oil component from the compressed gas.

The above-mentioned embodiment simply exemplifies a preferred specific example of the present invention, and the present invention is not limited to the above-mentioned embodiments. It should be understood that various modifications can be made within the scope of the claims of the present invention.

The invention claimed is:

1. An oil-cooled type screw compressor having a compressor body that compresses a suction gas, and discharges compressed gas, comprising:

a rotor casing of the compressor body;

a pair of male and female screw rotors that is stored in said rotor casing, the male and female screw rotors meshing with each other;

rotor shafts that are provided for each of said screw rotors, and that extend to both sides of each of said screw rotors, respectively;

a suction port that is provided for one side in a longitudinal direction of said screw rotors, and that introduces the suction gas to said pair of screw rotors;

a discharge port that is provided for the other side in the longitudinal direction of said screw rotors, and that discharges the compressed gas compressed by said screw rotors;

a disc-shaped thrust plate that is provided near either end portion of each of said rotor shafts, respectively, in the longitudinal direction, the disc-shaped thrust plates rotating integrally with said rotor shafts, respectively;

a sealing member that seals each respective thrust plate rotatably while spacing the thrust plates from said screw rotors, respectively, and the sealing members defining a first space and a second space on both sides of said thrust plates, respectively;

a pair of thrust bearings that is disposed in the first space and the second space respectively, the pair of thrust bearings receiving a thrust force transmitted to said respective thrust plates placed between said pair of thrust bearings;

an oil feed passage that communicates with one of said first space and said second space which is located on a side where a force is applied in a direction against the thrust force to the respective thrust plate when boosted, and that establishes communication between an inside of the one of said first and second spaces and an oil feed source;

an oil discharge passage that communicates with the other of said first space and said second space which is located on side where a force is applied in a direction against an anti-thrust force to the respective thrust plate when boosted, and that establishes the communication between an inside of the other of said first and second spaces and an oil discharge destination; and an oil distribution passage through which oil is distributed between said first space and said second space.

2. The oil-cooled type screw compressor according to claim 1, further comprising radial bearings provided on both sides, respectively, of each of said screw rotors, the radial bearings being mounted on said rotor casing so as to support said rotor shafts, respectively, of said screw rotors.

3. The oil-cooled type screw compressor according to claim 1, further comprising:

a slide valve that is provided for the compressor body, and that adjusts a discharge capacity of the compressed gas;

slide-valve-opening degree detection means that detects an opening degree of said slide valve; and flow rate control means that adjusts a flow rate of the oil fed to said first space according to the opening degree of said slide valve detected by said slide-valve-opening degree detection means to control a pressure of the oil in said first space.

4. The oil-cooled type screw compressor according to claim 3, wherein said flow rate control means is interposed on said oil feed passage, and is a flow-rate control valve, an opening degree of which is controlled to an arbitrary opening degree.

5. The oil-cooled type screw compressor according to claim 1, wherein said oil feed source is an oil sump unit at a bottom portion of an oil separator/collector that is interposed on a discharge flow passage for feeding the compressed gas discharged from the compressor body to a gas feed destination side, the oil sump unit separating an oil component from the compressed gas.

* * * * *